US006644028B1

(12) United States Patent
Swift et al.

(10) Patent No.: US 6,644,028 B1
(45) Date of Patent: Nov. 11, 2003

(54) METHOD AND APPARATUS FOR RAPID STOPPING AND STARTING OF A THERMOACOUSTIC ENGINE

(75) Inventors: Gregory W. Swift, Santa Fe, NM (US); Scott N. Backhaus, Espanola, NM (US); David L. Gardner, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/176,311

(22) Filed: Jun. 20, 2002

(51) Int. Cl.[7] ..... F01B 29/08
(52) U.S. Cl. ..... 60/516; 60/517; 60/721
(58) Field of Search ..... 60/516, 517, 682, 60/721; 62/6, 467

(56) References Cited

U.S. PATENT DOCUMENTS 4,599,551 A * 7/1986 Wheatley et al. ..... 322/2 R
4,858,441 A * 8/1989 Wheatley et al. ..... 62/6
4,953,366 A * 9/1990 Swift et al. ..... 62/467
5,561,984 A * 10/1996 Godshalk et al. ..... 62/51.1
6,021,643 A * 2/2000 Swift et al. ..... 62/6

* cited by examiner

*Primary Examiner*—Hoang Nguyen
(74) *Attorney, Agent, or Firm*—Ray G. Wilson

(57) ABSTRACT

A thermoacoustic engine-driven system with a hot heat exchanger, a regenerator or stack, and an ambient heat exchanger includes a side branch load for rapid stopping and starting, the side branch load being attached to a location in the thermoacoustic system having a nonzero oscillating pressure and comprising a valve, a flow resistor, and a tank connected in series. The system is rapidly stopped simply by opening the valve and rapidly started by closing the valve.

10 Claims, 4 Drawing Sheets

METHOD AND APPARATUS FOR RAPID STOPPING AND STARTING OF A THERMOACOUSTIC ENGINE

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to oscillating wave engines and thermoacoustic engines, including Stirling engines and thermoacoustic-Stirling hybrids.

BACKGROUND OF THE INVENTION

A variety of oscillating thermodynamic engines and refrigerators have been developed, including Stirling engines and refrigerators, Ericsson engines, orifice pulse-tube refrigerators, standing-wave thermoacoustic engines and refrigerators, free-piston Stirling engines and refrigerators, and thermoacoustic-Stirling hybrid engines and refrigerators. Much of the evolution of this entire family of oscillating thermodynamic technologies has been driven by the search for higher efficiencies, greater reliabilities, and lower fabrication costs.

Some combinations of one or more thermoacoustic engines and one or more thermoacoustic refrigerators or orifice pulse tube refrigerators, such as the thermoacoustic-Stirling hybrid engine driving three orifice pulse tube refrigerators shown in FIG. 1, have provided heat-driven refrigeration with no moving parts whatsoever. Such systems with no moving parts can yield the greatest reliability and lowest fabrication costs. As used herein, thermoacoustic engines mean both standing-wave thermoacoustic engines, in which stacks are used; thermoacoustic-Stirling hybrid engines, in which regenerators are used; and Stirling engines, in which regenerators are used.

FIG. 1 schematically shows one such prior art combined system 10. This combined system comprises a chain of energy-conversion hardware: a natural-gas-fired burner 12, which provides heat to a thermoacoustic-Stirling hybrid engine 14, which in turn provides acoustic power to an orifice pulse-tube refrigerator 16, which in turn cools and liquefies a purified natural gas stream. The conversion of heat to acoustic power occurs in regenerator 18 of engine 14, which is a solid matrix smoothly spanning the temperature difference between hot heat exchanger 22 and main ambient heat exchanger 24 of the engine and containing small pores through which the gas oscillates. The conversion of acoustic power to refrigeration takes place similarly in regenerator 26 spanning a temperature gradient between ambient heat exchanger 28 and cold heat exchanger 32.

Proper design of the resonator and total thermoacoustic system shown in FIG. 1 ensures that the system oscillates spontaneously at a desired frequency, called the resonance frequency, when it is operating. Acoustic energy stored in the resonance, comprising kinetic energy of oscillating motion and compressional energy of oscillating pressure, acts like a flywheel so that acoustic power production in the engine and acoustic power consumption in the refrigerators can take place at arbitrarily different temporal phasing within each cycle of the wave. Proper design of the acoustic network in which the engine's regenerator and heat exchangers are imbedded causes the gas in the pores of the engine's regenerator 18 to move toward hot heat exchanger 22 while the pressure is high and toward main ambient heat exchanger 24 while the pressure is low, these oscillations occurring at the resonance frequency.

Thus, the oscillating thermal expansion and contraction of the gas in regenerator 18, attending this oscillating motion along the steep temperature gradient in the pores, is temporally phased with respect to the oscillating pressure so that the thermal expansion occurs while the pressure is high and the thermal contraction occurs while the pressure is low. This expansion and contraction, properly phased with the oscillating pressure, is the thermodynamic work that produces acoustic power in engine 14, maintaining the oscillation against consumption of acoustic power by the loads. The load comprises, e.g., the refrigerator 16 and also dissipative effects throughout the system.

The discussion above relies strongly on sufficient steepness of the temperature gradient in regenerator 18 along the direction of the oscillating motion, but is only weakly dependent on the amplitude of the oscillation. With ambient temperature fixed, the steepness of the temperature gradient is controlled by the temperature of hot heat exchanger 22, henceforth called the hot temperature. Indeed, standing-wave thermoacoustic engines and thermoacoustic-Stirling hybrid engines can operate stably over a very broad range of oscillation amplitudes once the hot temperature exceeds a certain temperature, called the threshold temperature herein, with higher amplitudes associated with higher hot temperatures.

The threshold temperature depends on many details of the entire thermoacoustic system, including, in FIG. 1, the load provided by refrigerator 16. A greater load (e.g. an additional refrigerator that might be connected in parallel) would cause a higher threshold temperature. Low oscillation amplitudes are encountered when the hot temperature is only slightly above the threshold temperature, while the higher amplitudes are achieved when the hot temperature is significantly hotter than the threshold temperature. High amplitude is desirable in order to achieve the highest acoustic power, and thermoacoustic systems are typically designed for routine operation at a high amplitude, called herein the design operating amplitude. In stable operation at any amplitude, a balance exists between the acoustic power produced by the engine and the acoustic power consumed by loads such as refrigerators and dissipative effects throughout the system.

Typically, to start such an engine, beginning from a state in which all parts of the engine are at ambient temperature, burner 12 is ignited and begins producing heat. At first, the heat from burner 12 simply warms the massive parts of hot heat exchanger 22, burner 12 itself, and any hardware (not shown) associated with burner 12, such as a counterflow recuperator that might pre-heat the fresh air delivered to burner 12 by capturing waste heat from the exhaust downstream of burner 12 and hot heat exchanger 22. Hence, at first the temperatures of these parts of the system simply increase with time, and no thermoacoustic oscillations occur.

The rate of temperature increase of these temperatures depends on the output from burner 12 and the heat capacity of these parts of the system.

When the hot temperature finally reaches the threshold temperature, the thermoacoustic oscillations begin spontaneously at the resonance frequency, typically at an amplitude that is much smaller than the design operating amplitude. Increases in burner 12 power then increase the hot temperature and the amplitude of the oscillations, with most of the additional burner power going into the thermoacoustic processes. Eventually the design operating amplitude is reached, and the oscillation amplitude stabilizes with burner 12 supplying a fixed amount of heat.

Typically, to effect a complete shutdown of such an engine, beginning from a state in which it is oscillating at high amplitude, such as its design operating amplitude, burner 12 power is reduced or eliminated, and the temperature of hot heat exchanger 22 begins to fall due to consumption of heat by the thermoacoustic processes in the engine and due to heat leak from hot heat exchanger 22 to ambient. As the hot temperature falls, the amplitude of the oscillations decreases, and hence the rate of fall of temperature may decrease. Eventually, the hot temperature falls below the threshold temperature, and the oscillations cease. Further decrease in the hot temperature toward ambient then occurs, usually caused by heat leak from hot heat exchanger 22 to ambient temperatures, but sometimes accelerated by circulation of air or water.

Some hysteresis between turn-on threshold temperature and shutdown threshold temperature may occur, but this does not affect the operation of the present invention as described herein.

The entire startup procedure can be as long as many hours, depending on the heat capacity of the parts that must be heated and on other factors such as the need to avoid thermal-shock damage, i.e. overstressing parts by causing excessively steep temperature gradients. Both the time to safely heat the hot parts from ambient temperature to the threshold temperature and the time to safely heat them from the threshold temperature to the design operating temperature can be long. Similarly, the shutdown procedure described above can take a long time, with oscillations diminishing in amplitude during a period ranging from minutes to hours, depending on the specific hardware, and then cooling from the threshold temperature to ambient taking additional hours.

There are many circumstances in which the state of the art described above is unsatisfactory. For example:

1. A failure of burner 12 causes shutdown to proceed at a rate determined by the thermoacoustic phenomena which remove stored heat from the heat capacity of hot heat exchanger 22 and nearby hot parts. That rate might be too rapid and cause thermal-shock damage to the hot parts. Thus, it would be desirable to enable slower cooling even while the burner is inoperative.

2. A failure in another part of a complex facility in which thermoacoustic system 10 is imbedded might call for a rapid shutdown of thermoacoustic system 10. For example, failure of a methane pump that is supplying methane to refrigerators 16 might call for immediate shutdown of the thermoacoustic oscillations before the unloaded refrigerators cool below the freezing point of methane and create a plug of frozen methane in cold heat exchangers 32.

3. A temporary, rapid shutdown and restart of thermoacoustic system 10 might be desired, such as while quick repairs to a non-thermoacoustic portion of the facility are made.

Accordingly, there is a need to provide to thermoacoustic engines a means for rapid stopping and starting of the thermoacoustic oscillations, preferably with hardware that is simple, reliable, and cheap.

Various advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and lo broadly described herein, the present invention includes a thermoacoustic engine-driven system with a hot heat exchanger, a regenerator or stack, and an ambient heat exchanger, with a side branch load for rapid stopping and starting, the side branch load being attached to a location in the thermoacoustic system having a nonzero oscillating pressure and comprising a valve, a flow resistor, and a tank connected in series. The system is rapidly stopped by simply opening the valve and started by simply closing the valve.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Figure 1:
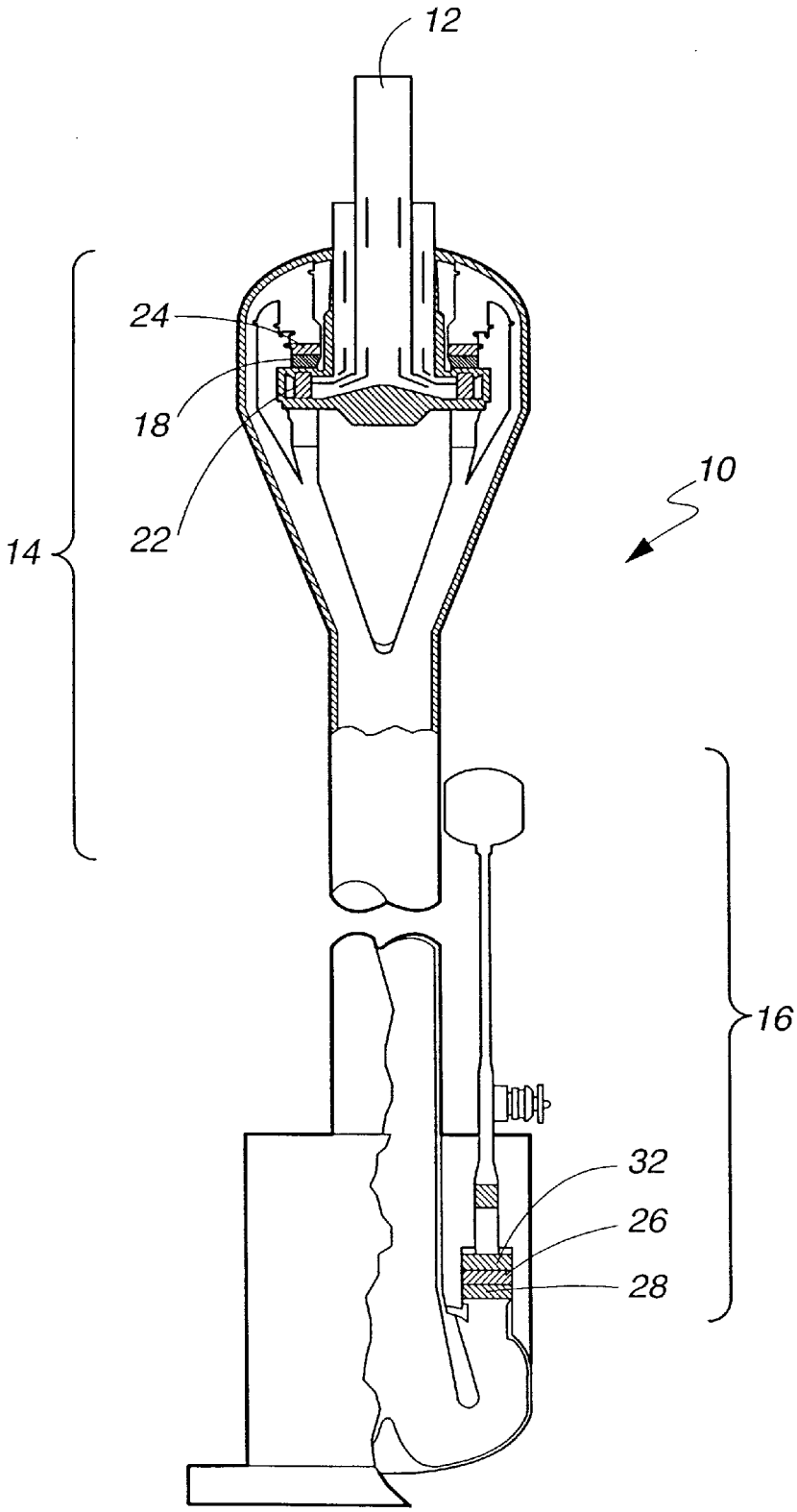
Fig. 1 (Prior Art)
FIG. 1 schematically depicts a prior art thermoacoustic system comprising a burner-driven engine, a resonator, and three orifice pulse tube refrigerators.
Figure 2A:
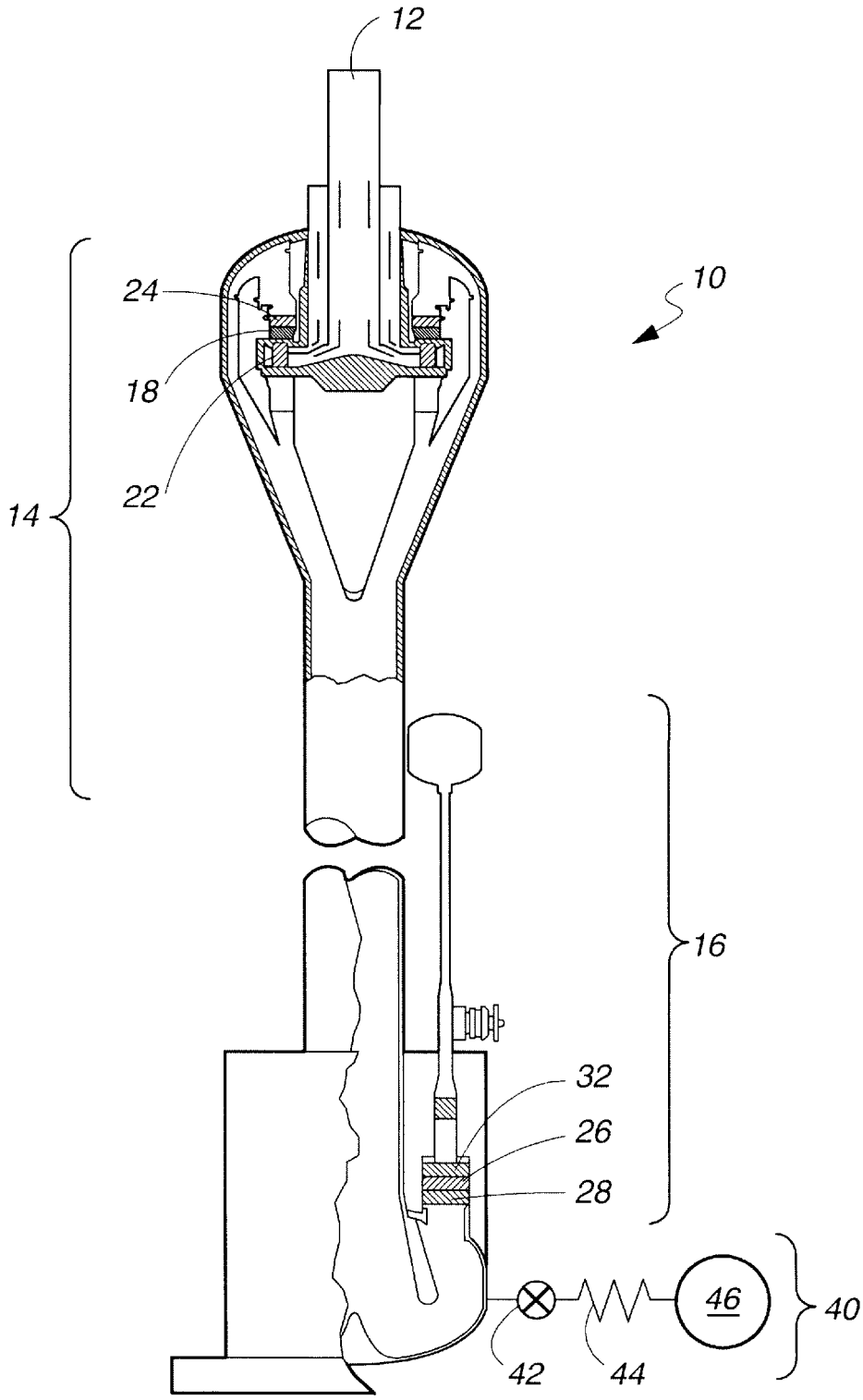
FIG. 2A is the thermoacoustic system depicted in FIG. 1, with the addition of the side branch mechanism of the present invention.

Referring first to FIG. 2A, rapid stopping and starting of a thermoacoustic system 10 in accordance with the present invention can be accomplished simply, reliably, and inexpensively by attaching to thermoacoustic system 10, at a location of nonnegligible oscillating pressure, a side branch loading mechanism 40 comprising a valve 42, a flow resistor 44, and a tank 46 in series, as shown schematically in FIG. 2A. Side branch mechanism 40 is filled with a thermoacoustic working gas, preferably at the same mean pressure as in the thermoacoustic system. While valve 42 is closed, side branch mechanism 40 has no effect on the thermoacoustic oscillations. When valve 42 is opened, side branch mechanism 40 imposes an additional load on the thermoacoustic system.

To operate as a rapid stopping and starting mechanism, side branch resistor 44 and tank 46 must be designed so that opening the valve while the system is oscillating at its design operating amplitude adds a large load to system 10, dramatically upsetting the balance previously existing between the acoustic power produced by engine 14 and the acoustic power consumed by any previous load(s). The hot temperature cannot increase dramatically and immediately in response to the opening of valve 42, so the loads (refrigerator 16 and side branch mechanism 40) consume more acoustic power than engine 14 produces. This power is consumed at the expense of the acoustic energy stored in the oscillations, so the amplitude of the oscillations decreases rapidly, to zero. At another time, if desired and if the hot temperature is not below the design operating temperature, valve 42 can be closed in order to reduce the total load to its original value, and system 10 quickly starts oscillating at its design operating amplitude.

Figure 2B:
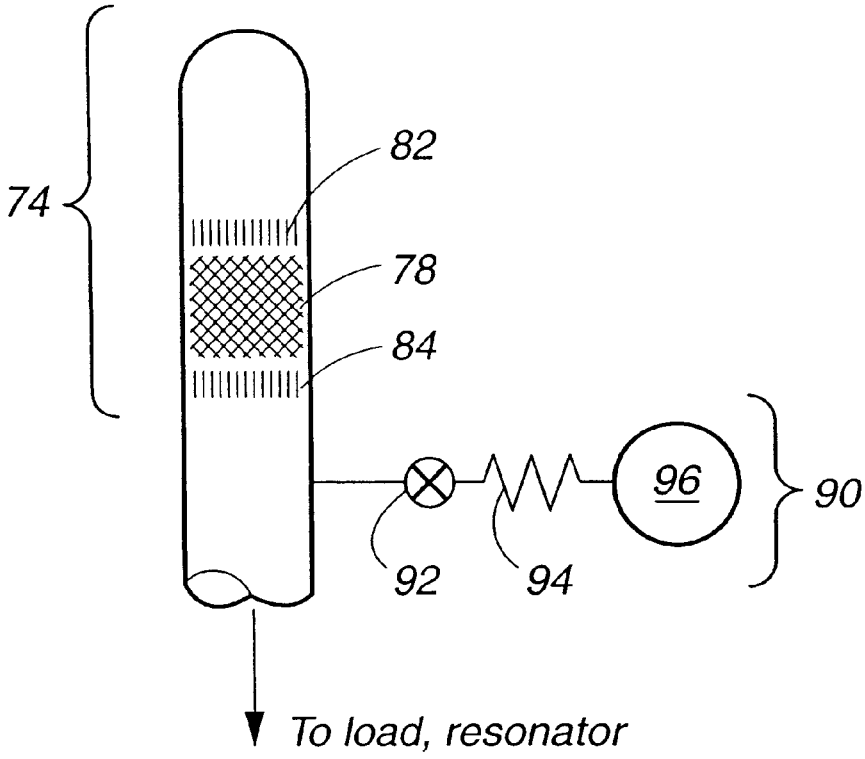
FIG. 2B is another thermoacoustic system with a side branch mechanism of the present invention.

The present invention can also be used with a standing-wave thermoacoustic engine, as shown in FIG. 2B. Standing-wave thermoacoustic engine 74 comprises stack 78, hot heat exchanger 82, and ambient heat exchanger 84. The temperature gradient in stack 78 is maintained by heat supplied to hot heat exchanger 82 and heat removed from ambient heat exchanger 84. The temperature gradient causes conversion of heat to acoustic power within the pores of stack 78 because thermal expansion of the gas therein occurs while the pressure is high and thermal contraction occurs while the pressure is low. Side branch loading mechanism 90, comprising valve 92, flow resistor 94, and tank 96 in series, is attached at a location of nonnegligible oscillating pressure, and functions as described above.

The desired rapidity of stopping or starting is a very important consideration. This can be characterized and estimated via the quality factor Q of the resonance. [Fundamentals of Acoustics, L. E. Kinsler, A. R. Frey, A. B. Coppens, and J. V. Sanders (4th edition, 1999, Wiley)]. A thermoacoustic engine system operating steadily at constant amplitude can be regarded as having infinite Q. When valve 42 or 92 to side branch mechanism 40 or 90 is then opened, the dissipation in resistance R of side branch resistor 44 or 94 causes the amplitude to decay in time according to $$e^{-\pi ft/Q} \qquad \text{Eq. 1}$$

where f is the oscillation frequency, t is time, and $$Q = \frac{2\pi f E_{stored}}{\dot{E}} \qquad \text{Eq. 2}$$

where $E_{stored}$ is the energy stored in the system resonance and $\dot{E}$ is the average power dissipation in the resistor.

Figure 3:
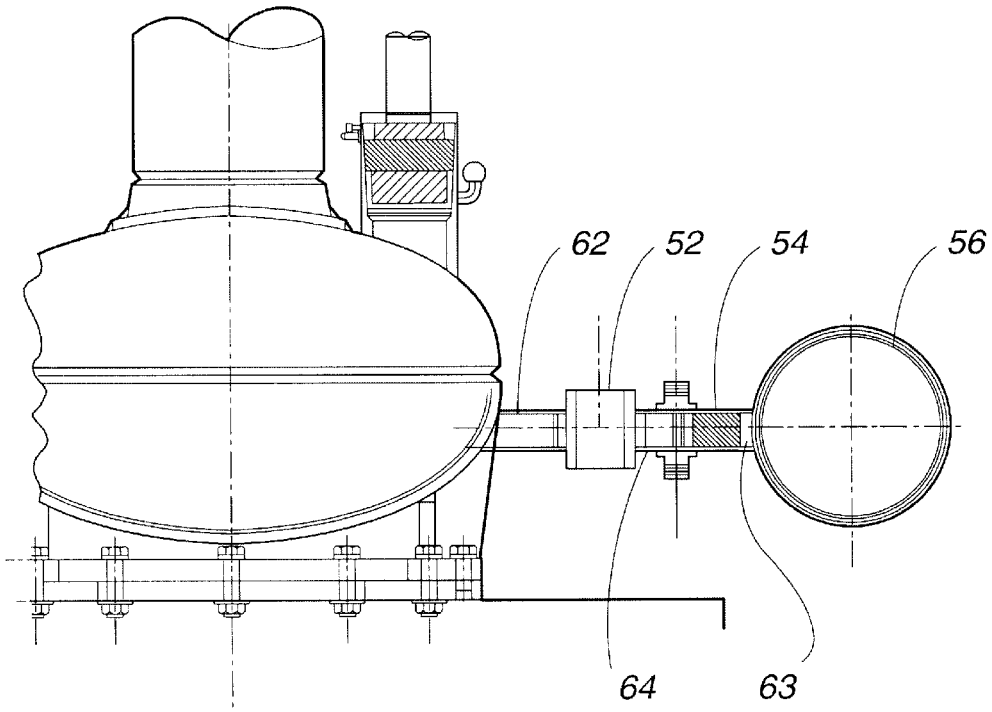
FIG. 3 more particularly depicts one embodiment of the present invention.

In an operating example, a side branch mechanism shown in FIG. 3 was designed for a thermoacoustic system operated at f=40 Hz with 3.1-MPa helium gas, where it was desired that opening valve 52 would cause the amplitude to decay with a characteristic time of approximately 1 second. Hence, $Q/\pi f=1$ s., so Q=125 was desired. The energy $E_{stored}$ stored in the resonance can be estimated approximately using either of $$E_{stored} \cong \frac{1}{2}\rho_m |u_{1,fast}|^2 V_{fast}, \qquad \text{Eq. 3}$$

$$E_{stored} \cong \frac{1}{2}\frac{1}{\rho_m a^2}|p_{1,high}|^2 V_{high} \qquad \text{Eq. 4}$$

where $\rho_m$ is the gas mean density, a is the gas sound speed, $|u_{1,fast}|$ is a characteristic velocity amplitude in the region of the resonator in which the oscillating-velocity is fastest during oscillation at the design operating amplitude, $V_{fast}$ is the approximate volume of that region, $|p_{1,high}|$ is a characteristic oscillating pressure amplitude in the region of the resonator in which the oscillating pressure is highest during oscillation at the design operating amplitude, and $V_{high}$ is the approximate volume of that region. This resulted in an estimate of $$E_{stored}=20{,}000 \text{ Joules} \qquad \text{Eq. 5}$$

at the system's design operating amplitude. If a more accurate estimate of $E_{stored}$ were required, numerical integration of either $|u_1|^2$ or $|p_1|^2$ throughout the volume of the apparatus could be performed.

Combining the estimate in Eq. 5 with the desired Q via Eq. 2 yields the necessary acoustic power dissipation in resistor 54 to be $\dot{E}$=40 kW. Finally, the necessary value of the resistance R of resistor 54 can be obtained from $$\dot{E} \cong \frac{1}{2}\frac{|p_{1,load}|^2}{R} \qquad \text{Eq. 6}$$

where $|p_{1,load}|$ is the amplitude of the oscillating pressure at the entrance to the side branch mechanism during oscillation at the design operating amplitude. For the operating system, this yielded R=1.2 MPa·s/m$^3$ at a location of high oscillating pressure where it seemed convenient to locate the side branch mechanism. Lower values of R result in faster shutdown. Resistor 54 was built to have $$R \cong 1 \text{ MPa}\cdot s/m^3 \qquad \text{Eq. 7}$$

For some thermoacoustic systems, a further consideration may impose a lower value on R. In some systems, the steady-state operating hot temperature depends extremely strongly on the oscillation amplitude, with the temperature rising with rising amplitude. In such a system, opening the valve to the side branch mechanism initiates $e^{-\pi ft/Q}$ decay of amplitude described above. As the amplitude drops, the system might rapidly establish a new steady-state oscillation amplitude, lower than the original amplitude, with acoustic power production in the engine at the existing hot temperature and at the new, lower amplitude in balance with the acoustic power consumption of the loads at the new, lower amplitude.

In some circumstances this switched operation might be desired (so that the engine could be rapidly switched between two different operating amplitudes) but, in the case of the operating engine, a complete shutdown was desired, so the DeltaE thermoacoustic design computer code was used to model the entire system at various amplitudes, both with and without the side branch valve open. DeltaE, by W. C. Ward and G. W. Swift, was first described in J. Acoust. Soc. Am. 95, 3671–3672 (1994), and an up-to-date description is available at www.lanl.gov/thermoacoustics. Another, equally useful thermoacoustic design computer code is Sage, by David Gedeon, which was first described in D. Gedeon, "A globally implicit Stirling cycle simulation," in the Proceedings of the 21st Intersociety Energy Conversion Engineering Conference (American Chemical Society, 1986) page 550, and is available from David Gedeon in Athens, Ohio.

It was found numerically that the amplitude dependence of the hot temperature in this system was not extremely strong. At all amplitudes, the system with the side branch valve 52 open could not oscillate while the hot temperature of the engine was equal to the operating hot temperature at the design operating amplitude. Hence, no further reduction in the value of R was necessary and the resistor was built as noted in Eq. 7.

In order for Eq. 6 to be accurate, the impedance $\frac{1}{2}\pi fC$ of tank 56, where C is the compliance of tank 56, must be negligibly small compared to R. For example, for a 1% accuracy in Eq. 6, make $$1/2\pi fC \leq \frac{R}{100};$$

for a 10% accuracy in Eq. 6, make $$1/2\pi fC \leq \frac{R}{10}.$$

It was decided that a factor of 10 smaller would suffice for this approximate design. Hence, the design called for $$C=4\times10^{-8}\ \mathrm{m}^{3/Pa} \qquad \text{Eq. 8}$$

It was also necessary that the impedance $2\pi fL$ of any inertance L in the side branch mechanism, such as in the valve passage or in connecting piping 62, 63, 64 between the components, should be at least 10 times smaller than R so the design required that $$L<4000\ \mathrm{kg}/m^4 \qquad \text{Eq. 9}$$

From the required values for R, C, and L given in Eqs. 7, 8, and 9, a specific hardware design was completed.

Using the well known expression for compliance $C=V/\gamma\rho_m$ where V is the volume of gas in tank 56, $\gamma$ is the ratio of isothermal to adiabatic compressibilities of the gas (1.666 for monatomic gases such as helium, 1.4 for diatomic gases such as air), and $\rho_m$ is the mean pressure of the gas, the required volume $V=0.2\ \mathrm{m}^2$ was obtained. Tank 56 was constructed by welding together a suitable length of large diameter pipe and two end caps.

Resistor 54 must dissipate approximately $E_{stored}$=20,000 Joules each time that it is used for shutdown. Rather than provide cooling water to the resistor, the exemplary resistor was designed with enough solid heat capacity to absorb this much heat without dangerous temperature rise. Resistor 54 was made using 1 kg of stainless steel (specific heat 450 J/kg/C), keeping the expected temperature rise at an extremely conservative 40 degrees C.

Resistor 54 was constructed from a bed of metal screen trapped in a pipe. Packing 1 kg of circular pieces of screen in a long, thin pipe would entail handling many pieces, while configuring it as a few large-diameter screens would lead to an awkwardly large pipe diameter. The final design was a pipe segment with a length of 11 cm and a diameter of 7 cm, filled with the circular pieces of screen. Data in standard fluid-mechanics references [e.g., Compact Heat Exchangers, W. M. Kays and A. L. London, (McGraw-Hill, New York, 1964)] or built into computer codes such as DeltaE and Sage then allowed selection of the mesh size of the screen to obtain the desired $R=1\ \mathrm{MPa\cdot s/m^3}$. The selected mesh size was 10 mesh (i.e., 10 wires per inch) square-weave screen with wire diameter 0.025 inch.

An added feature of this resistance is that it becomes lower at lower amplitude, due to the well known Reynolds number dependence of the friction factor of screen beds. Thus, the shutdown rate of decay of amplitude increases at lower amplitudes.

The cross-sectional area of resistor 54 was large enough to keep flow velocities below approximately $\alpha/10$ to avoid sonic choking and/or shock waves in the oscillating flow. With the volume flow rate through resistor 54 estimated as $|p_{1,load}|/R$, a bound on area A was obtained, where $$A \gtrsim \frac{10|p_{1,load}|}{aR} = 3\ \mathrm{cm}^2, \qquad \text{Eq. 10}$$

so no adjustment to the earlier choice of diameter 7 cm was needed. The factor of 10 in Eq. 10 is conservative enough to accommodate blockage of typically half of the pipe are by the wires of which the screens are woven.

A convenient pneumatically activated valve 52, and connecting piping 62, 63, 64, with a similar area A, were selected, and the total length A, of these components was 0.5 m. The inertance of these components was then estimated using $$L=\rho_m\Delta x/A, \qquad \text{Eq. 11}$$

yielding $L=600\ \mathrm{kg/m^4}$. This is well below the bound estimated above at Eq. 9, so no further design changes were required by that criterion.

The side branch mechanism shown in FIG. 3, and designed in accordance with the above considerations, worked as expected, allowing stopping and starting of the system with time constants of approximately 1 second.

It will be appreciated that the invention is also applicable to thermoacoustic engines using pistons instead of long resonators. Such pistons can operate as linear alternators in order to generate electricity, or they can transmit useful oscillatory work to a gas or liquid.

It will also be appreciated that the open valve itself will sometimes, by design, have enough flow impedance that it functions as the resistor. In this situation, the valve and the resistor described above exist within the same hardware component.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In a thermoacoustic engine-driven system with a hot heat exchanger, a regenerator or stack, and an ambient heat exchanger, a side branch load for rapid stopping and starting, the side branch load being attached to a location in the thermoacoustic system having a nonzero oscillating pressure and comprising a valve, a flow resistor, and a tank connected in series.

2. The side branch load of claim 1, where the resistor has a resistance R determined from the relationship $$\dot{E} \cong \frac{1}{2}\frac{|p_{1,load}|^2}{R},$$

where $|p_{1,load}|$ is the amplitude of the oscillating pressure at the location of the side branch mechanism during oscillation at a design operating amplitude, and $\dot{E}$ is an acoustic power dissipation for stopping the thermoacoustic system at a given rate.

3. The side branch load of claim 1 where the tank has a compliant impedance that is smaller than a resistance of the resistor.

4. The side branch load of claim 3, where the resistor has a resistance R determined from the relationship $$\dot{E} \cong \frac{1}{2}\frac{|p_{1,load}|^2}{R},$$

where $|p_{1,load}|$ is the amplitude of the oscillating pressure at the location of the side s branch mechanism during oscillation at a design operating amplitude, and $\dot{E}$ is an acoustic power dissipation for stopping the thermoacoustic system at a given rate.

5. The side branch load of claim 1, further including structure connecting the system, valve, resistor, and tank, wherein an inertial impedance of the connecting structure is at least ten times less than a resistance of the valve.

6. The side branch load of claim 5, where the resistor has a resistance R determined from the relationship $$\dot{E} \cong \frac{1}{2}\frac{|p_{1,load}|^2}{R},$$

where $|p_{1,load}|$ is the amplitude of the oscillating pressure at the location of the side branch mechanism during oscillation at a design operating amplitude, and $\dot{E}$ is an acoustic power dissipation for stopping the thermoacoustic system at a given rate.

7. The side branch load of claim 1, wherein the resistor has a cross-sectional area large enough to keep fluid flow velocities through the resistor below about $\alpha/10$, where $\alpha$ is the speed of sound in an operating fluid of the thermodynamic system.

8. A method for rapid stopping and starting of a thermoacoustic engine-driven system including:

attaching to a location of nonzero oscillating pressure of the thermoacoustic engine-driven system a side branch load comprising a valve, flow resistor, and a tank connected in series;

opening the valve to stop the system and closing the valve to start the system.

9. The method of claim 8, including selecting a resistance R for the flow resistor determined from the relationship $$\dot{E} \cong \frac{1}{2}\frac{|p_{1,load}|^2}{R},$$

where $|p_{1,load}|$ is the amplitude of the oscillating pressure at the location of the side branch mechanism during oscillation at a design operating amplitude, and $\dot{E}$ is an acoustic power dissipation for stopping the thermoacoustic system at a given rate.

10. The method of claim 9, including selecting a resistor with a cross-sectional area large enough to keep fluid flow velocities through the resistor below about $\alpha/10$, where $\alpha$ is the speed of sound in an operating fluid of the thermodynamic system.

* * * * *